United States Patent [19]

Thorne-Thomsen

[11] 4,416,142

[45] Nov. 22, 1983

[54] APPARATUS FOR SIMULTANEOUSLY FORMING A CAP MEMBER WITH INTERNAL THREADS

[75] Inventor: Thomas Thorne-Thomsen, Godfrey, Ill.

[73] Assignee: Olin Corporation, New Haven, Conn.

[21] Appl. No.: 297,813

[22] Filed: Aug. 31, 1981

[51] Int. Cl.[3] ..... B21D 22/20; B21D 53/24; B21K 1/56

[52] U.S. Cl. ..... 72/348; 10/76 R; 10/152 R; 72/355; 72/356; 72/399

[58] Field of Search ..... 10/72 R, 72 CN, 76 R, 10/86 R, 86 F, 152 R; 72/348, 354, 355, 356, 393, 399

[56] References Cited

U.S. PATENT DOCUMENTS

| | | | |
|---|---|---|---|
| 1,048,584 | 12/1912 | Rich | 72/393 |
| 1,378,980 | 5/1921 | Rockwood et al. | 10/152 R |
| 2,349,037 | 5/1944 | Gibbs | 72/399 |
| 2,400,961 | 5/1946 | Thayer | 10/152 R |
| 2,429,376 | 10/1947 | Stagmeier | 72/348 X |
| 3,006,003 | 10/1961 | Johnson, Jr. | 10/86 |
| 3,748,674 | 7/1973 | Powell et al. | 10/72 R |

FOREIGN PATENT DOCUMENTS

| | | | |
|---|---|---|---|
| 453363 | 12/1927 | Fed. Rep. of Germany | 72/355 |

*Primary Examiner*—Ervin M. Combs
*Attorney, Agent, or Firm*—Howard M. Cohn; Barry L. Kelmachter; Paul Weinstein

[57] ABSTRACT

An apparatus and process is disclosed for forming a cap-like member from a blank of material. The apparatus comprises a die for shaping the cap-like member. A device is provided to co-act with the die for simultaneously forming both the member and internal threads within the member.

5 Claims, 5 Drawing Figures

APPARATUS FOR SIMULTANEOUSLY FORMING A CAP MEMBER WITH INTERNAL THREADS

While the invention is subject to a wide range of applications, it is especially suited for use in making a cap with internal threads and more particularly to a method and apparatus for simultaneously forming the cap with the internal threads.

Coupling nuts used for various plumbing and electrical connections involving an internally threaded coupling nut are generally produced from bar stock by machining methods. Similar coupling nuts are less commonly produced from sheet metal by a cupping method followed by a secondary machining operation for the threads. In the latter instance, the secondary machining operation causes a significant increase in the cost of manufacture of the coupling nuts.

In U.S. Pat. No. 3,006,003 to Johnson, a method is disclosed for swaging interrupted threads in a sheet metal nut. The nut is threaded after it has been completely formed.

In U.S. Patent No. 3,748,674 to Powell et al., a method and apparatus of forming sheet metal hex nuts is disclosed wherein the nut is first formed and then threads are tapped into the interior surface of the nut.

It is a problem underlying the present invention to provide a process and apparatus for forming a cap-like member which is able to efficiently and economically form threaded nuts.

It is an advantage of the present invention to provide an apparatus for forming a cap-like member which substantially obviates one or more of the limitations and disadvantages of the described prior arrangements.

It is a further advantage of the present invention to provide an apparatus for forming a cap-like member from a blank of material having internal threads which are formed simultaneously with the forming of the cap-like member.

Accordingly, there has been provided an apparatus and process for forming a cap-like member from a blank of material. The apparatus comprises a die for shaping the cap-like member. A device is provided to co-act with the die for simultaneously forming both the member and internal threads within the member.

The invention and further developments of the invention are now elucidated by means of the preferred embodiments shown in the drawings.

Figure 4:
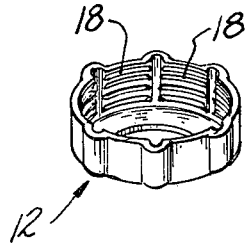

FIG. 4 a plan view of a cap-like element; and

Figure 5:
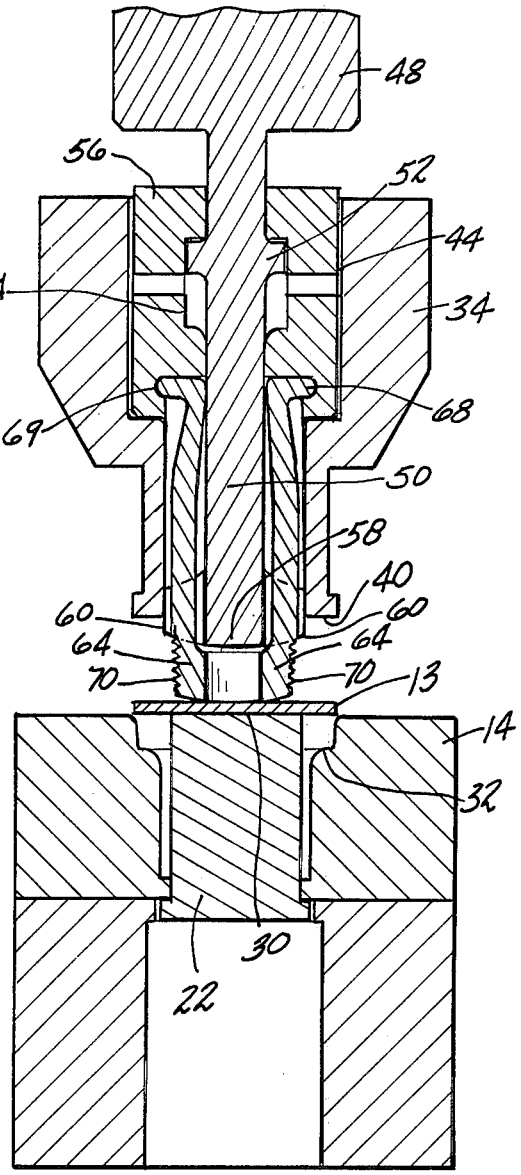

FIG. 5 is a schematic representation of the apparatus for forming cap-like members in a position to receive a blank.

In accordance with the present invention, an apparatus 10 is disclosed for forming a cap-like member 12 from a blank of material 13. The apparatus includes a die 14 for shaping the cap-like member. A device 16 co-acts with the die 14 for simultaneously forming both the member 12 and internal threads 18 within the member.

Figure 1:
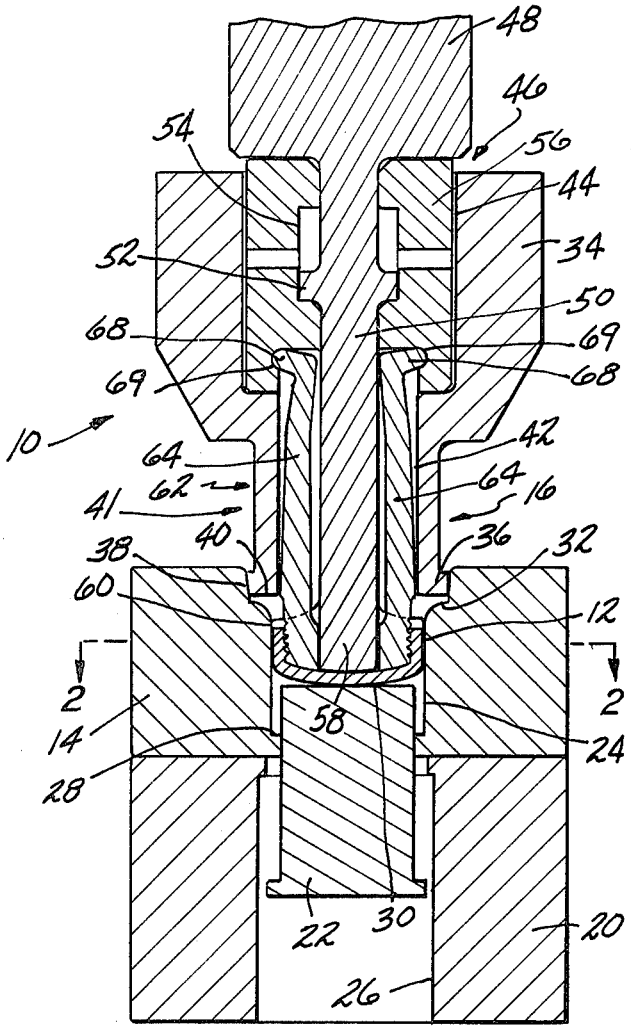
FIG. 1 is a schematic representation of an apparatus for forming cap-like members in accordance with the present invention.

Referring to FIG. 1, there is shown an apparatus 10 for forming a cap-like member, preferably a hexagonal nut as shown in FIG. 4. The apparatus 10 includes a base 20 which supports the die 14. A knockout member 22 reciprocates axially within the die opening 24 as well as within a base passageway 26. The movement and timing of the knockout member may be controlled in any desired manner, such as a cam device in conjunction with a shaft(not shown).

Figure 2:
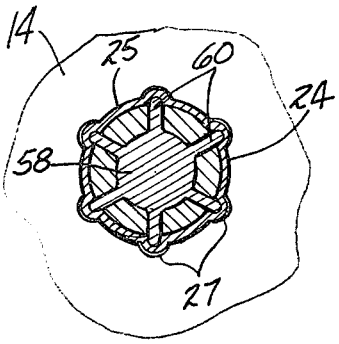
FIG. 2 is a sectional view through line 2—2 of FIG. 1.

The die 14 has an opening 24 which is generally shaped as illustrated in FIG. 2. In the preferred embodiment, the peripheral wall 25 is substantially circular and includes six semi-circular, equally spaced openings 27 around the wall 25. It is further within the scope of the present invention to reshape the die through altering the wall 25 or the number or shape of openings 27. A rim 28 is provided along the bottom of the die opening to provide a base surface in the die in conjunction with the top surface 30 of the knockout member 22. The die 14 further includes a ridge 32, substantially perpendicular to a vertical wall 38, for initially receiving the blank 13 of material.

A plunger device 16, for simultaneously forming both the member and the internal threads within the member, includes a hold-down member 34 which has a lip 36. The lip 36 is shaped to be received within the vertical wall 38 of the die extending above the shoulder 32. The bottom surface 40 of the lip 36 functions to both push the blank into engagement with the shoulder 32 at the beginning of the formation of the cap and to strip off the finished cap from the punch as will be further described. The hold-down member includes a lower opening 42 for receiving a punch device 41 (described below) and an upper opening 44 for receiving the punch operating apparatus 46. The hold-down member is operated and timed independently by a device such as a cam on a shaft (not shown).

The punch operating apparatus 46 includes a ram 48 30 which is reciprocated, by any suitable means, to perform the metal forming operations contemplated by this invention. The ram 48 is affixed to a rod 50 having a piston-like projection 52. This projection reciprocates in a cylinder 54 provided in the punch operator 56. The operator 56 reciprocates in the upper opening 44 of the hold-down member 34. The lower end of rod 50 makes up part of the punch device 41 and has a splined punch 58 provided on its lower end. The splined punch 58, as shown in FIG. 2, has a substantially circular cross section with a plurality of splines 60 projecting from the periphery thereof. In the preferred embodiment, the six splines 60 are equidistant apart along the periphery of the punch. This arrangement provides a substantially hexagonal cap. It is, however, within the scope of the present invention to provide any desired cross section with any desired number of splines and to orient them as desired. Of course, the splines co-act with the die and as such must conform to the configuration of the die.

Figure 3:
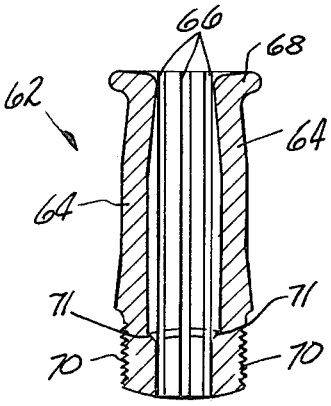
FIG. 3 is a sectional view through the segmented punch.

The punch device 41 further includes a segmented punch 62. The punch is comprised of a plurality of segments 64 as shown in FIG. 3. The segments are grouped together in the punch operating apparatus 46 to form a substantially tubular member. Further, the segments are separated by slots 66 which are wide enough to receive the splines 60 of the splined punch 58. The top portion of each segment 64 has a curved lip 68 which is received in a corresponding curved section 69 of the punch operator 56, see FIG. 1. An inclined edge 71 is provided on the inner side of the segments, as best seen in FIG. 3, to co-act with the circular end portion of the splined punch and force the segments into a fully-extended, open position. The bottom external surface of each of the segments 64 has thread-forming ridges 70 which are adapted to be pressed into the internal surface of the cap 12 as it is being formed. These thread-forming ridges may be sized in accordance with the desired internal threads within the finished cap.

In order to better understand the present invention invention, a description of a cycle of its operation follows. Referring to FIG. 5, the cycle may commence with a blank automatically (or manually) fed into the apparatus 10 and placed on the knockout member 22 whose top surface 30 is substantially flush with the top surface of the die 14. At this point of the cycle, the ram 48 may be in its upper most position with the piston 52 resting against the upper edge of the cylinder 54. Then the hold-down member 34 moves downward so that its bottom surface 40 presses the blank against the circular shoulder 32. Simultaneously, the knockout member 22 moves downward at a rate whereby its top surface 30 is constantly supporting the blank as it moves downward into the die. Then the ram 48 begins to move downward causing the piston 52 to travel to the bottom of cylinder 54. The movement of the ram drives the rod 50 and thus the splined punch 58 downward and forces the loose, collapsed segments 64 outward away from each other. The circular end of the splined punch pushes on the inner inclined edge 71 of the segments 64 and forces the segments to spread outward. At this time, the splines 60 are moving in the slots 66 provided between the segments 64. Just as the piston 52 engages the bottom edge of the cylinder 54, the splined punch reaches the end of its travel in the segmented punch causing the segments 64 and the threaded portions 70 to be fully extended outward and rigidly maintained in that position. The combination of the splined punch and the segmented punch, in this latter locked position, provides a substantially solid plunger for pushing the blank into the die. The blank is actually pushed into the die by the ram 48 continuing its downward movement.The latter movement forces the punch operator 56 downward due to piston 52, see FIG. 1. The result is the splined punch in cooperation with the segmented punch pushes the blank into the die to form a cup having an outside configuration which matches the configuration of the die. The inside of the cup follows the configuration of the threaded portions 70 and the splines 60.

It can be appreciated that the threads 18 are coined into the inside sidewall of the cap, see FIG. 4. The depth of the threads depends on the clearance between the threaded portions 70 and the sidewalls. A significant advantage to this process is that the threads are formed simultaneously with the formation of the cap. Since high forces and pressures are created during the formation of the threads and the cap, the use of a substantially solid member, i.e. the spline punch in conjunction with the segmented punch, allows the metal to easily form the cup with the internal threads.

The process continues with the removal of the completed cap member from the die. At this point in the cycle, all the working members are at the bottom of the stroke, as in FIG. 1. The cycle continues with the knockout member 22, the hold-down member 34, the ram 48, and the punch operator 56 raising up together to move the completed cap out of the die. As noted before, the knockout member 22 and the hold-down member34 are operated independently of the ram 48 although their movement coincides with the movement of the ram48 as required. At the time the knockout member 22 has reached the top of its cycle, as shown in FIG. 5, the hold-down member 34 has also reached the top of its cycle, also shown in FIG. 5. At this point, the splined punch is still fully extended in the segmented punch and the threaded cap is securely held onto the threaded portion 70 of the segmented punch. The ram 48 continues to move upward pulling the piston 52 to the top of the cylinder 54 and the splined punch to its uppermost position, above the edge 71, within the segmented punch. The segmented punch is now free to collapse inwardly, i.e. pivot about the curved lips 68 within the sections 69, so that the cap may be released from the threaded portions 70. In order to insure that the cap falls away from the threaded portions of the segments 64, the ram 48 moves further upward carrying the punch operator and the segmented punch with it. Once the cap hits the bottom surface 40 of the hold-down member, it drops off onto the top surface 30 of the knockout member 22. Then a removal apparatus (not shown) takes the cap and moves it to another station as required. At this point, the cycle is ready to begin again as described hereinabove.

Although a segmented punch system with an inner splined punch has been described, it is within the scope of the present invention to use any other type of suitable punch system. It can also be appreciated that the present invention has the capability of forming the threaded caps without requiring an opening in the cap to allow for its removal from the punch.

It is apparent that there has been provided in accordance with this invention a cap member forming apparatus which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for forming a cap-like memberfrom a blank of material comprising:

die means for shaping the cap-like member;

plunger means co-acting with the die means for simultaneously forming the member with internal threads therein, said plunger means including a movable punch operator having an opening with a substantially curved slot at one end; and a collapsed, segmented punch having a plurality of segments separated by longitudinal slots, each of said segments having a lip on one end being pivotally received within said curved slot for supporting said segment, and one or more of said segments further having external threads on a second end thereof;

a reciprocating rod extending through said plunger having a plurality of splines at one end projecting into each of said longitudinal slots, said rod fastening the lips of said segments within said curved slot;

said segments being pivoted about said lips between a collapsed position whereby said segments are movable inwardly toward said rod corresponding to rod movement in one direction and to an expanded position wherein the rod movement is in a second direction so that the rod end having said splines thereon engages the second end of said segments and forces them outward resulting in a solid plunger to push said blank into the die means and form said cap having substantially the configuration of said die means.

2. The apparatus of claim 1 further including a knockout member reciprocating within said die means, said knockout member moving in one direction to support said blank between said knockout member and said plunger means as the blank moves into said die means.

3. The apparatus of claim 2 wherein said knockout member further moves in a second direction to push the formed cap-like member out of said die means.

4. The apparatus of claim 3 wherein said movable punch operator further includes a reciprocating hold-down member at the second end of said opening, said hold-down member moving into a first position within said die means to press said blank into said die means prior to said solid plunger pushing said blank into the die means.

5. The apparatus of claim 4 wherein said movable punch operator further moves to a second position out of said die means to release the cap from said external threads after said rod has moved in the first direction and said segments are in a collapsed position.

* * * * *